US009103351B2

(12) United States Patent
P et al.

(10) Patent No.: US 9,103,351 B2
(45) Date of Patent: Aug. 11, 2015

(54) COOLING PUMP FOR A COOLING SYSTEM

(71) Applicant: GM GLOBAL TECHNOLOGY OPERATIONS LLC, Detroit, MI (US)

(72) Inventors: Selvaganesh P, Bangalore (IN); Jennifer A Graham, Addison Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 319 days.

(21) Appl. No.: 13/647,477

(22) Filed: Oct. 9, 2012

(65) Prior Publication Data

US 2014/0099192 A1 Apr. 10, 2014

(51) Int. Cl.

| | |
|---|---|
| ***F04D 29/40*** | (2006.01) |
| ***F04D 29/42*** | (2006.01) |
| ***F04D 13/02*** | (2006.01) |
| *F01P 5/10* | (2006.01) |

(52) U.S. Cl.

CPC ..... *F04D 29/4293* (2013.01); *F04D 13/02* (2013.01); *F04D 29/40* (2013.01); *F04D 29/406* (2013.01); *F01P 5/10* (2013.01)

(58) Field of Classification Search

CPC ..... F04D 29/40; F04D 29/406; F04D 29/422; F04D 29/426; F04D 11/00; F04D 11/005

See application file for complete search history.

(56) References Cited

U.S. PATENT DOCUMENTS

| | | | | |
|---|---|---|---|---|
| 2,849,960 | A * | 9/1958 | Olmstead et al. | 415/204 |
| 5,899,662 | A | 5/1999 | Hojyo et al. | |
| 6,241,481 | B1 | 6/2001 | Keyes et al. | |
| 2008/0168956 | A1 * | 7/2008 | Lutz et al. | 123/41.1 |

FOREIGN PATENT DOCUMENTS

| | | | |
|---|---|---|---|
| DE | 102008039700 | A1 | 3/2009 |
| GB | 2205611 | A | 12/1988 |
| WO | 2004088103 | A1 | 10/2004 |

* cited by examiner

*Primary Examiner* — Lindsay Low
*Assistant Examiner* — Jacob Amick
(74) *Attorney, Agent, or Firm* — Quinn Law Group, PLLC

(57) ABSTRACT

A cooling pump receives fluid from a heating system and supplies cooled fluid to an engine. The cooling pump includes a body housing and a cover housing. The cover housing is attached to the body housing to define an internal pumping chamber. The internal pumping chamber is defined between an inlet passage and an outlet passage of the body housing. A chamber outlet opening is defined between the internal pumping chamber and the outlet passage such that fluid flows from the internal pumping chamber and into the outlet passage. The cover housing includes a sloped wall which extends into the outlet passage between the chamber outlet opening and a terminus. The sloped wall has a concave portion and a convex portion disposed such that the concave portion is between the chamber outlet opening and the convex portion to direct fluid through the outlet passage and into the engine.

20 Claims, 2 Drawing Sheets

COOLING PUMP FOR A COOLING SYSTEM

TECHNICAL FIELD

The present disclosure generally relates to a cooling pump for a cooling system.

BACKGROUND

Rapid warm-up of engine coolant, engine oil, and transmission oil after a cold start can improve vehicle fuel economy. A cold start is a start-up of the vehicle when the vehicle has not been running and the engine and transmission are relatively cold. Engine warm-up is especially challenging for diesel and hybrid applications, as less fuel is burned.

SUMMARY

A cooling pump is configured to receive fluid from a heating system and to supply cooled fluid to an engine of a vehicle. The cooling pump includes a body housing and a cassette assembly. The body housing defines an inlet passage and an outlet passage. The inlet passage is configured to receive fluid from the heating system. The outlet passage is configured to supply cooled fluid to the engine. The outlet passage includes a first section. The cassette assembly includes a cover housing, a drive member, and an impeller. The cover housing is operatively attached to the body housing such that the body housing and the cover housing define an internal pumping chamber. The drive member is configured to rotate about an axis. The impeller is disposed within the internal pumping chamber and is operatively connected to the drive member such that the impeller rotates about the axis to draw fluid into the internal pumping chamber from the inlet passage in response to rotation of the drive member about the axis. The internal pumping chamber is defined in fluid communication between the inlet passage and the outlet passage. The body housing defines a chamber outlet opening between the internal pumping chamber and the first section of the outlet passage such that fluid flows from the internal pumping chamber and into the first section of the outlet passage through the chamber outlet opening. The cover housing includes a sloped wall extending into the first section of the outlet passage between the chamber outlet opening and the terminus. The sloped wall has a concave portion and a convex portion disposed such that the concave portion is between the chamber outlet opening and the convex portion.

In another aspect, a cooling system is configured to supply cooled fluid to an engine of a vehicle. The cooling system includes a heating system and a cooling pump. The cooling pump is fluidly connected to the heating system and is configured to be fluidly connected to the engine. The cooling pump includes a body housing and a cassette assembly. The body housing defines an inlet passage and an outlet passage. The inlet passage receives fluid from the heating system. The outlet passage is configured to supply cooled fluid to the engine. The outlet passage includes a first section. The cassette assembly includes a cover housing, a drive member, and an impeller. The cover housing is operatively attached to the body housing such that the body housing and the cover housing define an internal pumping chamber. The drive member is configured to rotate about an axis. The impeller is disposed within the internal pumping chamber and is operatively connected to the drive member such that the impeller is configured to rotate about the axis to draw fluid into the internal pumping chamber from the inlet passage in response to rotation of the drive member about the axis. The internal pumping chamber is defined in fluid communication between the inlet passage and the outlet passage. The body housing defines a chamber outlet opening between the internal pumping chamber and the first section of the outlet passage such that fluid flows from the internal pumping chamber and into the first section of the outlet passage through the chamber outlet opening. The cover housing includes a sloped wall extending into the first section of the outlet passage between the chamber outlet opening and the terminus. The sloped wall has a concave portion and a convex portion disposed such that the concave portion is between the chamber outlet opening and the convex portion.

In yet another aspect, a powertrain for a vehicle includes an engine, a heating system, and a cooling pump. The cooling system includes a heating system and a cooling pump. The cooling pump is fluidly connected between the heating system and the engine. The cooling pump includes a body housing and a cassette assembly. The body housing defines an inlet passage and an outlet passage. The inlet passage receives fluid from the heating system. The outlet passage supplies cooled fluid to the engine. The outlet passage includes a first section. The cassette assembly includes a cover housing, a drive member, and an impeller. The cover housing is operatively attached to the body housing such that the body housing and the cover housing define an internal pumping chamber. The drive member is configured to rotate about an axis. The impeller is disposed within the internal pumping chamber and is operatively connected to the drive member such that the impeller is configured to rotate about the axis to draw fluid into the internal pumping chamber from the inlet passage in response to rotation of the drive member about the axis. The internal pumping chamber is defined in fluid communication between the inlet passage and the outlet passage. The body housing defines a chamber outlet opening between the internal pumping chamber and the first section of the outlet passage such that fluid flows from the internal pumping chamber and into the first section of the outlet passage through the chamber outlet opening. The cover housing includes a sloped wall extending into the first section of the outlet passage between the chamber outlet opening and the terminus. The sloped wall has a concave portion and a convex portion disposed such that the concave portion is between the chamber outlet opening and the convex portion.

The above features and advantages and other features and advantages of the present teachings are readily apparent from the following detailed description of the best modes for carrying out the present teachings when taken in connection with the accompanying drawings.

DETAILED DESCRIPTION

Figure 1:
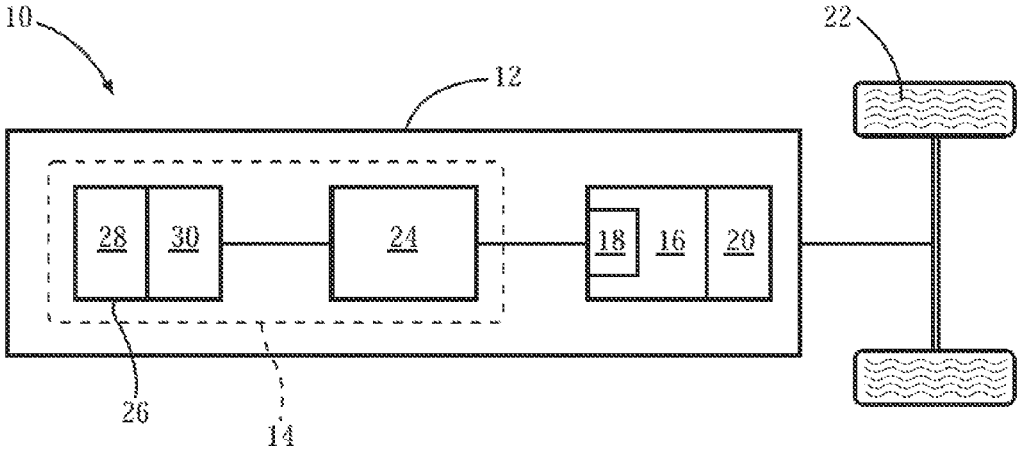
FIG. 1 is a schematic illustration of a vehicle having a cooling system, including a cooling pump.

Referring to the drawings, wherein like reference numbers refer to like components throughout the several views, FIG. 1 shows a vehicle 10 that has a powertrain 12 and a cooling system 14 operable to increase vehicle 10 efficiency. The powertrain 12 includes an engine 16 that has an engine block 18. The powertrain 12 also includes a transmission 20 that is operatively connected to the engine 16 and driven by the engine 16 to propel wheels 22 of the vehicle 10.

The cooling system 14 includes a cooling pump 24 and a heating system 26. The heating system 26 may include a heater 28 and a radiator 30. The cooling pump 24 is fluidly disposed in communication between the engine 16 and the heating system 26. More specifically, the cooling pump 24 is configured to pump fluid received from the heater 28 and/or the radiator 30 and supply the pumped fluid to the engine block 18. The fluid is cooled as it is pumped through the cooling pump 24. The fluid may be a coolant. By way of a non-limiting example, ethylene-glycol-based coolants, such as a DEX-COOL™ brand of coolant, may be used. It should be appreciated that other coolants may also be used.

Figure 2:
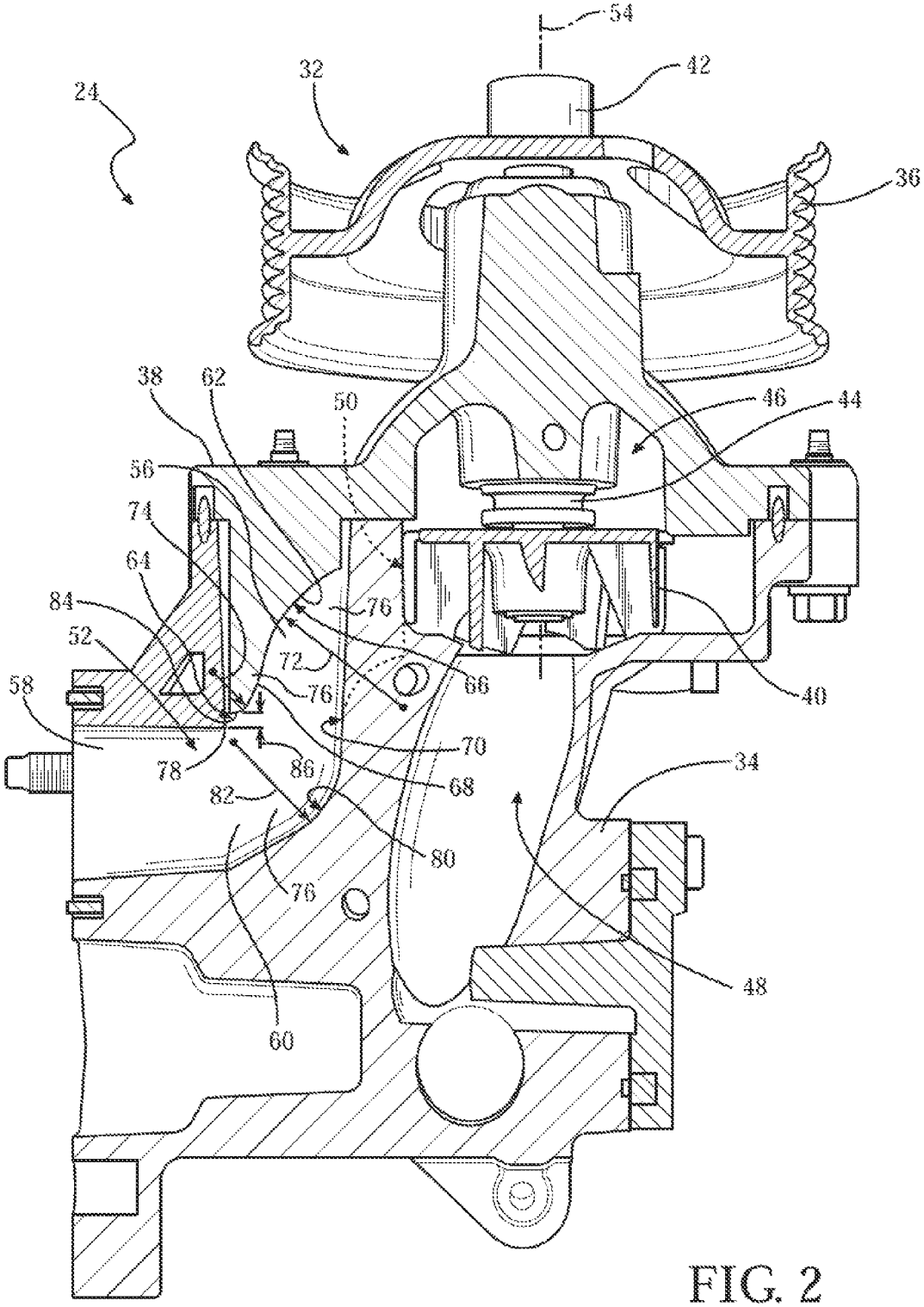
FIG. 2 is a schematic cross sectional illustration of the cooling pump of FIG. 1.

Referring now to FIG. 2, the cooling pump 24 includes a cassette assembly 32 and a body housing 34. The cassette assembly 32 includes a drive member 36, a cover housing 38, an impeller 40, a shaft 42, and a bearing 44. The cover housing 38 is operatively attached to the body housing 34 such that the body housing 34 and the cover housing 38 cooperate to define an internal pumping chamber 46. The body housing 34 defines an inlet passage 48 which opens to the internal pumping chamber 46. Fluid is received from the heater 28 and/or the radiator 30 into the inlet passage 48 and flows from the inlet passage 48 to the internal pumping chamber 46. The body housing 34 also defines a chamber outlet opening 50 and an outlet passage 52. The chamber outlet opening 50 opens from the internal pumping chamber 46 into the outlet passage 52. Fluid flows from the internal pumping chamber 46 through the chamber outlet opening 50 and into the outlet passage 52, as explained in more detail below. The outlet passage 52 is in fluid communication with the engine block 18.

The bearing 44 supports the shaft 42, which is rotatable on an axis 54 and rotatably supported by the cover housing 38, within the internal pumping chamber 46. More specifically, the drive member 36, the cover housing 38, the impeller 40, the shaft 42, and the bearing 44 may be press fit together along the axis 54 such that the impeller 40, a portion of the shaft 42, and the bearing 44 are disposed within the internal pumping chamber 46. The shaft 42 extends along the axis 54 and rotatably interconnects the drive member 36 and the impeller 40. More specifically, in operation, an accessory drive belt (not shown) connects the drive member 36 to rotate the shaft 42 and the impeller 40 to operate the pump. In such operation, the drive member 36 may be a pulley, as shown in FIG. 2. Alternatively, the shaft 42 may be directly driven by a gear or motor (not shown), which engage the drive member 36.

The inlet passage 48 extends into the internal pumping chamber 46 generally along the axis 54. Rotation of the impeller 40 draws fluid into the internal pumping chamber 46, along the axis 54, from the inlet passage 48. Further, rotation of the impeller 40 expels the fluid from the internal pumping chamber 46, through the chamber outlet opening 50. The chamber outlet opening 50 is disposed generally perpendicularly to the axis 54. The fluid is expelled from the internal pumping chamber 46 through the chamber outlet opening 50 and into the outlet passage 52.

The outlet passage 52 includes a first section 56, a second section 58, and an elbow section 60. The first section 56 extends in generally parallel relationship to the axis 54. The elbow section 60 interconnects the first section 56 and the second section 58 such that the second section 58 extends generally perpendicularly from the first section 56.

The cover housing 38 includes a sloped wall 62, which extends into the first section 56 of the outlet passage 52. The sloped wall 62 faces the chamber outlet opening 50. The sloped wall 62 extends between the chamber outlet opening 50 and a terminus 64. The sloped wall 62 includes a concave portion 66 and a convex portion 68. The concave portion 66 is disposed proximate the chamber outlet opening 50 such that the concave portion 66 extends between the chamber outlet opening 50 and the convex portion 68. The convex portion 68 is disposed proximate the elbow section 60. Accordingly, fluid flows into the first section 56 through the chamber outlet opening 50 such that the fluid is directed respectively by the concave portion 66, the convex portion 68, and the elbow section 60. The first section 56 further includes a posterior wall 70 disposed opposite the sloped wall 62. The posterior wall 70 extends between the chamber outlet opening 50 and the elbow section 60.

The concave portion 66 has a first radius 72 and the convex portion 68 has a second radius 74 where the second radius 74 is smaller than the first radius 72. More specifically, the second radius 74 of the convex portion 68 may be between 10% and 20% of the first radius 72 of the concave portion 66. In one embodiment, the second radius 74 is between 15% and 16% of the first radius 72. The concave portion 66 and the convex portion 68 each generally present a quadrant 76 of a quarter circle such that the quadrants 76 are disposed diagonally opposite one another and that the sloped wall 62 undulates between the chamber outlet opening 50 and the terminus 64.

The elbow section 60 includes a corner 78 and a concave wall 80. The concave wall 80 is disposed in spaced relationship to the corner 78, between the posterior wall 70 and the second section 58. The corner 78 is disposed between the posterior sloped wall 62 and the second section 58. The corner 78 may be a substantially right angle such that the second section 58 extends in generally perpendicular relationship to the first section 56. The concave wall 80 is curved and has a third radius 82. The third radius 82 generally presents a quadrant 76 of a quarter circle in substantially the same quadrant 76 as the second radius 74 of the convex portion 68. The third radius 82 is smaller than the first radius 72 of the concave portion 66 and larger than the second radius 74 of the convex portion 68. The third radius 82 is between 60% and 70% of the first radius 72. More specifically, the third radius 82 is substantially 69% of the first radius 72. Likewise, the second radius 74 is substantially 16% of the third radius 82.

The first section 56 further includes a ledge wall 84 disposed between the terminus 64 and the corner 78 of the elbow section 60. The ledge is a linearly extending wall which extends a distance 86. The distance 86 is smaller than each of the first radius 72 and the second radius 74. The distance 86 is between 50% and 60% of the second radius 74. More specifically, the distance 86 is substantially 57% of the second radius 74.

The second section 58 extends between the elbow portion and the engine block 18. Additionally, the second section 58 diverges from the elbow portion.

Therefore, fluid flowing through the chamber outlet opening 50 is directed respectively through the first section 56, the elbow section 60, and the second section 58. More specifically, the concave portion 66, the convex portion 68 and the ledge wall 84 result in a reduced vortex structure and, hence a higher flow rate, over designs that do not use this combination. More specifically, as compared to a design with a first section 56 only having a concave portion 66, an approximately 16% gain in the flow rate, with a slight pressure drop at a pump head (not shown), may be achieved. A higher flow rate of the fluid to the engine block 18 improves cooling of the engine 16. Further a reduction in cavitation of the second section 58 may be achieved, due to a reduced outlet restriction.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. A cooling pump configured to receive fluid from a heating system and to supply cooled fluid to an engine of a vehicle, the cooling pump comprising:

a body housing defining an inlet passage and an outlet passage;

wherein the inlet passage is configured to receive fluid from the heating system;

wherein the outlet passage is configured to supply cooled fluid to the engine; and a cassette assembly including:

a cover housing operatively attached to the body housing such that the body housing and the cover housing define an internal pumping chamber;

a drive member configured to rotate about an axis;

an impeller disposed within the internal pumping chamber and operatively connected to the drive member such that the impeller is connected to rotate about the axis to draw fluid into the internal pumping chamber from the inlet passage in response to rotation of the drive member about the axis;

wherein the internal pumping chamber is defined in fluid communication between the inlet passage and the outlet passage;

wherein the outlet passage includes a first section, a second section, and an elbow section;

wherein the elbow section interconnects the first section and the second section such that the second section extends in generally perpendicular relationship to the first section;

wherein the body housing defines a chamber outlet opening between the internal pumping chamber and the first section of the outlet passage such that fluid flows from the internal pumping chamber and into the first section of the outlet passage through the chamber outlet opening;

wherein the cover housing includes a sloped wall extending into the first section of the outlet passage between the chamber outlet opening and a terminus;

wherein the sloped wall has a concave portion and a convex portion disposed such that the concave portion is between the chamber outlet opening and the convex portion;

wherein the concave portion has a first radius and the convex portion has a second radius smaller than the first radius; and wherein the concave portion and the convex portion each present a quadrant of a circle such that the respective quadrants are diagonally opposite one another and the sloped wall undulates between the chamber outlet opening and the terminus.

2. A cooling pump, as set forth in claim 1, wherein the second radius is between 10% and 20% of the first radius.

3. A cooling pump, as set forth in claim 1, wherein the first section further includes a posterior wall disposed in spaced relationship to the sloped wall;

wherein the elbow portion includes a corner and a concave wall disposed in spaced relationship to the corner;

wherein the corner is disposed between the sloped wall and the second section; and wherein the concave wall is disposed between the posterior wall and the second section and has a third radius smaller than the first radius.

4. A cooling pump, as set forth in claim 3, wherein the second radius is generally between 10% and 20% of the first radius.

5. A cooling pump, as set forth in claim 1, wherein the second section extends from the elbow portion and is configured to supply fluid to the engine.

6. A cooling pump, as set forth in claim 5, wherein the first section further presents a ledge wall disposed between the terminus and the corner of the elbow section;

wherein the ledge wall linearly extends a distance which is smaller than the first radius.

7. A cooling pump, as set forth in claim 6, wherein the distance is generally between 50% and 60% of the first radius.

8. A cooling system configured to supply cooled fluid to an engine of a vehicle, the cooling system comprising:

a heating system; and a cooling pump fluidly connected to the heating system and configured to be fluidly connected to the engine, the cooling pump including:

a body housing defining an inlet passage and an outlet passage;

wherein the inlet passage receives fluid from the heating system;

wherein the outlet passage is configured to supply cooled fluid to the engine;

wherein the outlet passage includes a first section; and a cassette assembly including:

a cover housing operatively attached to the body housing such that the body housing and the cover housing define an internal pumping chamber;

a drive member configured to rotate about an axis;

an impeller disposed within the internal pumping chamber and operatively connected to the drive member such that the impeller is connected to rotate about the axis to draw fluid into the internal pumping chamber from the inlet passage in response to rotation of the drive member about the axis;

wherein the internal pumping chamber is defined in fluid communication between the inlet passage and the outlet passage;

wherein the outlet passage includes a first section, a second section, and an elbow section;

wherein the elbow section interconnects the first section and the second section such that the second section extends in generally perpendicular relationship to the first section;

wherein the body housing defines a chamber outlet opening between the internal pumping chamber and the first section of the outlet passage such that fluid flows from the internal pumping chamber and into the first section of the outlet passage through the chamber outlet opening;

wherein the cover housing includes a sloped wall extending into the first section of the outlet passage between the chamber outlet opening and a terminus;

wherein the sloped wall has a concave portion and a convex portion disposed such that the concave portion is between the chamber outlet opening and the convex portion;

wherein the concave portion has a first radius and the convex portion has a second radius smaller than the first radius; and wherein the concave portion and the convex portion each present a quadrant of a circle such that the respective quadrants are diagonally opposite one another and the sloped wall undulates between the chamber outlet opening and the terminus.

9. A cooling system, as set forth in claim 8, wherein the second radius is between 10% and 20% of the first radius.

10. A cooling system, as set forth in claim 8, wherein the first section further includes a posterior wall disposed in spaced relationship to the sloped wall;

wherein the elbow portion includes a corner and a concave wall disposed in spaced relationship to the corner;

wherein the corner is disposed between the sloped wall and the second section; and wherein the concave wall is disposed between the posterior wall and the second section and has a third radius smaller than the first radius.

11. A cooling system, as set forth in claim 10, wherein the third radius is generally between 60% and 70% of the first radius.

12. A cooling system, as set forth in claim 8, wherein the second section extends from the elbow portion and is configured to supply fluid to the engine.

13. A cooling system, as set forth in claim 12, wherein the first section further presents a ledge wall disposed between the terminus and the corner of the elbow section;

wherein the ledge wall linearly extends a distance which is smaller than the first radius.

14. A cooling system, as set forth in claim 13, wherein the distance is generally between 50% and 60% of the second radius.

15. A powertrain for a vehicle, the powertrain comprising:

an engine;

a heating system; and a cooling pump fluidly connected between the heating system and the engine, the cooling pump including:

a body housing defining an inlet passage and an outlet passage;

wherein the inlet passage receives fluid from the heating system;

wherein the outlet passage supplies cooled fluid to the engine;

a cassette assembly including:

a cover housing operatively attached to the body housing such that the body housing and the cover housing define an internal pumping chamber;

a drive member configured to rotate about an axis;

an impeller disposed within the internal pumping chamber and operatively connected to the drive member such that the impeller is connected to rotate about the axis to draw fluid into the internal pumping chamber from the inlet passage in response to rotation of the drive member about the axis;

wherein the internal pumping chamber is defined in fluid communication between the inlet passage and the outlet passage;

wherein the outlet passage includes a first section, a second section, and an elbow section;

wherein the elbow section interconnects the first section and the second section such that the second section extends in generally perpendicular relationship to the first section;

wherein the body housing defines a chamber outlet opening between the internal pumping chamber and the first section of the outlet passage such that fluid flows from the internal pumping chamber and into the first section of the outlet passage through the chamber outlet opening;

wherein the cover housing includes a sloped wall extending into the first section of the outlet passage between the chamber outlet opening and a terminus;

wherein the sloped wall has a concave portion and a convex portion disposed such that the concave portion is between the chamber outlet opening and the convex portion;

wherein the concave portion has a first radius and the convex portion has a second radius smaller than the first radius; and wherein the concave portion and the convex portion each present a quadrant of a circle such that the respective quadrants are diagonally opposite one another and the sloped wall undulates between the chamber outlet opening and the terminus.

16. A powertrain, as set forth in claim 15, wherein the first section extends in generally parallel relationship to the axis.

17. A cooling system, as set forth in claim 10, wherein the corner is a substantially right angle such that the second section extends in generally perpendicular relationship to the first section.

18. A cooling system, as set forth in claim 8, wherein the first section extends in generally parallel relationship to the axis.

19. A cooling pump, as set forth in claim 3, wherein the corner is a substantially right angle such that the second section extends in generally perpendicular relationship to the first section.

20. A cooling pump, as set forth in claim 1, wherein the first section extends in generally parallel relationship to the axis.

* * * * *